US006726156B1

(12) United States Patent
Scola

(10) Patent No.: US 6,726,156 B1
(45) Date of Patent: Apr. 27, 2004

(54) HOLDER FOR A BAG

(76) Inventor: Vito A. Scola, 137 Apple Gate Rd., Cranston, RI (US) 02920

( * ) Notice: Subject to any disclaimer, the term of this patent is extended or adjusted under 35 U.S.C. 154(b) by 0 days.

(21) Appl. No.: 10/185,535

(22) Filed: Jun. 28, 2002

(51) Int. Cl.[7] ..... B65B 67/12
(52) U.S. Cl. ..... 248/95; 248/99; 248/100
(58) Field of Search ..... 248/95, 99, 100, 248/101; 493/226; 383/15, 22, 25, 26, 28, 29, 6

(56) References Cited

U.S. PATENT DOCUMENTS

| | | | | | |
|---|---|---|---|---|---|
| 4,669,689 | A | * | 6/1987 | Jones | 248/99 |
| 4,695,020 | A | * | 9/1987 | Collins | 248/100 |
| 4,838,504 | A | * | 6/1989 | Bittenbinder | 248/100 |
| 4,881,706 | A | | 11/1989 | Sedlik | 248/99 |
| 4,998,694 | A | | 3/1991 | Barteaux | 248/102 |
| 5,005,791 | A | | 4/1991 | Lanzen | 248/99 |
| 5,050,825 | A | * | 9/1991 | Bratset | 248/97 |
| 5,464,102 | A | * | 11/1995 | LeBlanc et al. | 211/12 |
| D391,722 | S | * | 3/1998 | Sheppard | D34/5 |
| 5,887,748 | A | | 3/1999 | Nguyen | 220/485.28 |
| 5,927,660 | A | * | 7/1999 | McNerney et al. | 248/95 |
| D422,891 | S | * | 4/2000 | Ohlman, III | D8/373 |
| 6,152,407 | A | | 11/2000 | McKenzie | 248/95 |
| 6,152,408 | A | | 11/2000 | O'Grady | 248/100 |
| 6,155,521 | A | | 12/2000 | O'Hanlon | 248/99 |

* cited by examiner

*Primary Examiner*—Anita King
*Assistant Examiner*—Steven Marsh
(74) *Attorney, Agent, or Firm*—Salter & Michaelson

(57) ABSTRACT

A holder for supporting a bag having handles in an open position is disclosed. The holder includes a mounting member to removably mount the holder to a support structure, and a pair of support arms which interlock with the handles of the bag during use. The support arms extend from the mounting member, include a pair of notches on an upper edge thereof, and a pair of cutout portions on the bottom coners of each support arm. In use, the handles of the bag are disposed from an inner surface of an adjacent support arm, outwardly through the upper notches, extend downwardly over an outer surface of either arm, and are secured within the lower corner cutout portions of each arm. The interlocking of the handles and the arms allows the bag to maintain an open position, while providing sufficient support for items placed within the bag.

6 Claims, 4 Drawing Sheets

HOLDER FOR A BAG

TECHNICAL FIELD

The invention relates generally to a holder for a bag, and more particularly to a device for retaining a bag having handles in an open, supported position. The invention is particularly adapted to the type of plastic bag commonly used in supermarkets and the like.

BACKGROUND OF RELATED ART

Various devices for holding bags, such as plastic supermarket bags, in at least a partially open position are well known in the art. These holders take any of a number of forms, including for example the holders disclosed in U.S. Pat. No. 4,881,706 to Sedlik; U.S. Pat. No. 4,998,694 to Barteaux; U.S. Pat. No. 5,005,791 to Lanzen; U.S. Pat. No. 5,887,748 to Nguyen; U.S. Pat. No. 6,152,407 to McKenzie; U.S. Pat. No. 6,152,408 to O'Grady; and U.S. Pat. No. 6,155,521 to O'Hanlon.

U.S. Pat. No. 4,881,706 to Sedlik discloses a bag holder including a back and two spaced forwardly projecting arms having notches to retain the bag handle, and top edges to maintain the bag in a fully open condition. The arms extend from the back and each include top handle notches. Each of the top handle notches includes a central tab. A pair of bag upper edge notches are also formed in each arm. In use, the handles of the bag are positively retained around their corresponding central tabs. The handles are looped around the central tabs and rest on an inside portion of the arms. The front and rear edges of the bag are held in place by the bag upper edge notches.

U.S. Pat. No. 4,998,694 to Barteaux discloses a bag holder having a support frame and a pair of collapsible swing arms connected on opposed ends of the support frame. Adjustable and lockable mounting brackets are provided for removably mounting the support frame on a support surface, for example, a drawer. The bag is retained in an open position on the swing arm by looping the handles of the bag around retention posts and slots. The bag holder further includes a deflection plate used to deflect refuse into the bag.

U.S. Pat. No. 5,005,791 to Lanzen discloses a bag holder including a base attachable to a vertical surface, and a pair of hinged arms which are hingedly connected to the base and constructed to support a bag having handles in an open position. Nestable spaces for the arms are provided within the surface of the base, and hinges connecting the arms to the base permit the arms to be turned from the nested position to the open or useful position. The handles of a bag are looped over spaced notches formed in the upper edge of each arm such that the central portions of the handles lay on an outside surface of the arms.

U.S. Pat. No. 5,887,748 to Nguyen discloses a device for supporting a bag with handles within a receptacle. The bag supporting device is positioned over the ends of the receptacle and each include a bag supporting portion for receiving the handles of the bag.

U.S. Pat. No. 6,152,407 to McKenzie discloses a holder or stand used to hold shopping bags having handles for reuse as refuge containers. The stand includes a shallow base pan which provides a platform for the bag, and also includes taper side risers, each side riser having a tapered neck riser over which the plastic bag handles are placed in order to hold the bag in an open position.

U.S. Pat. No. 6,152,408 to O'Grady discloses a bag holder having a back panel which is securable to an interior surface of a kitchen cabinet door, and a pair of side panels which are pivotally coupled to the back panel. The pair of side panels each include a horizontal upper edge having a pair of small arcuate recesses formed therein in spaced relation and dimensioned to receive opposing sides of the handles of bag.

U.S. Pat. No. 6,155,521 to O'Hanlon discloses a bag holder including a body having a pair of open ended slots which open onto an upper side of the body. In use, the handles of the bag are received within the slots. The holder further includes a hook element which can be positioned over a cabinet door or the like, and an expander, used to expand the diameter of the bag.

All of the bag holders disclosed in the above-identified patents are designed to hold a bag in at least a partially open position, the bag including a pair of handles which are utilized to removably secure the bag to the holder. While bag holders of the aforementioned type are useful in holding bags with handles, they do not always do so in a reliable manner capable of providing sufficient support for items placed in the bag. In addition, some of the holders are relatively complex in their design both in terms of manufacture and use. Therefore, there is a continued need in the art for a holder which can provide support to a bag with handles in order to maintain the bag in an open position, which is easy to use and manufacture, and which provides sufficient support when filled.

SUMMARY

It is an object of the bag holder disclosed herein to provide a device which can be used to recycle plastic bags having handles so that they may be used again in an efficient manner, for example to hold items such as refuse. The holder is simple in both construction and use, and provides support to the bag in an open position, even when the bag is full. The holder includes a mounting member designed to removably mount the holder to a support structure, for example, a cabinet door or drawer. A pair of support arms extend from either side end of the mounting member and are supported thereon, the handles of the bag being removably interlocked with the support arms during use. The support arms preferably include a pair of notches on an upper edge thereof, along with a pair of cutout portions on the corners disposed between the lower and side edges of each of the support arms. The holder may also include a reverse flange or hook extending from a top edge of the mounting member, the hook being designed to removable mount the holder over the top edge of the support structure. In one embodiment, the holder is constructed as a single unitary device. In use, the handles of the bag are interlocked through the upper notches, extend over an outer surface of either arm, and are secured within the lower corner cutout portions of each arm. The interlocking of the handles and the arms allows the bag to maintain an open position, while providing sufficient support for items placed within the bag during use.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
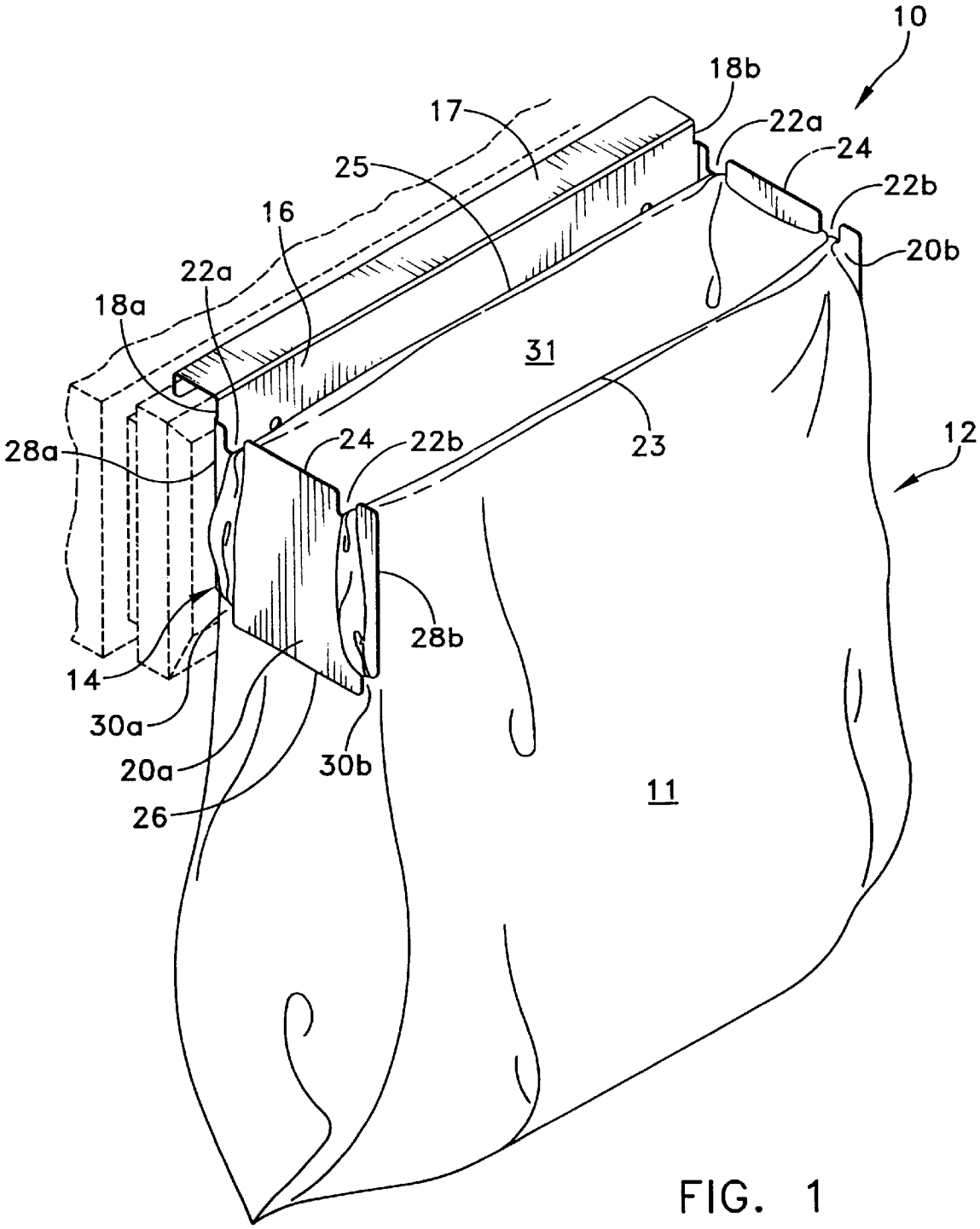
FIG. 1 is a perspective view of the bag holder of the present invention with a bag positioned in interlocking relationship with the holder.
Figure 2:
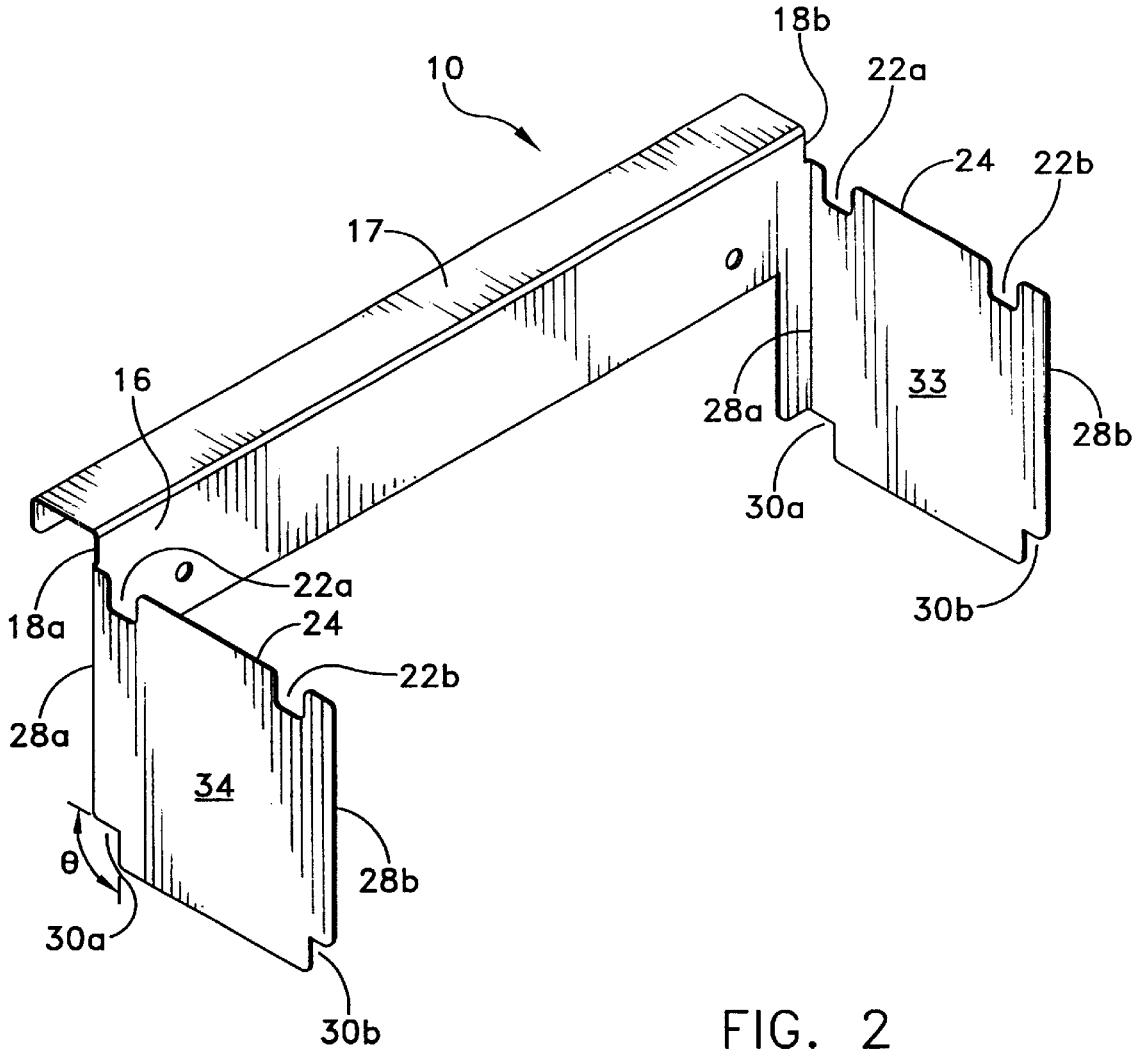
FIG. 2 is a perspective view of the holder of FIG. 1 without the bag.
Figure 3:
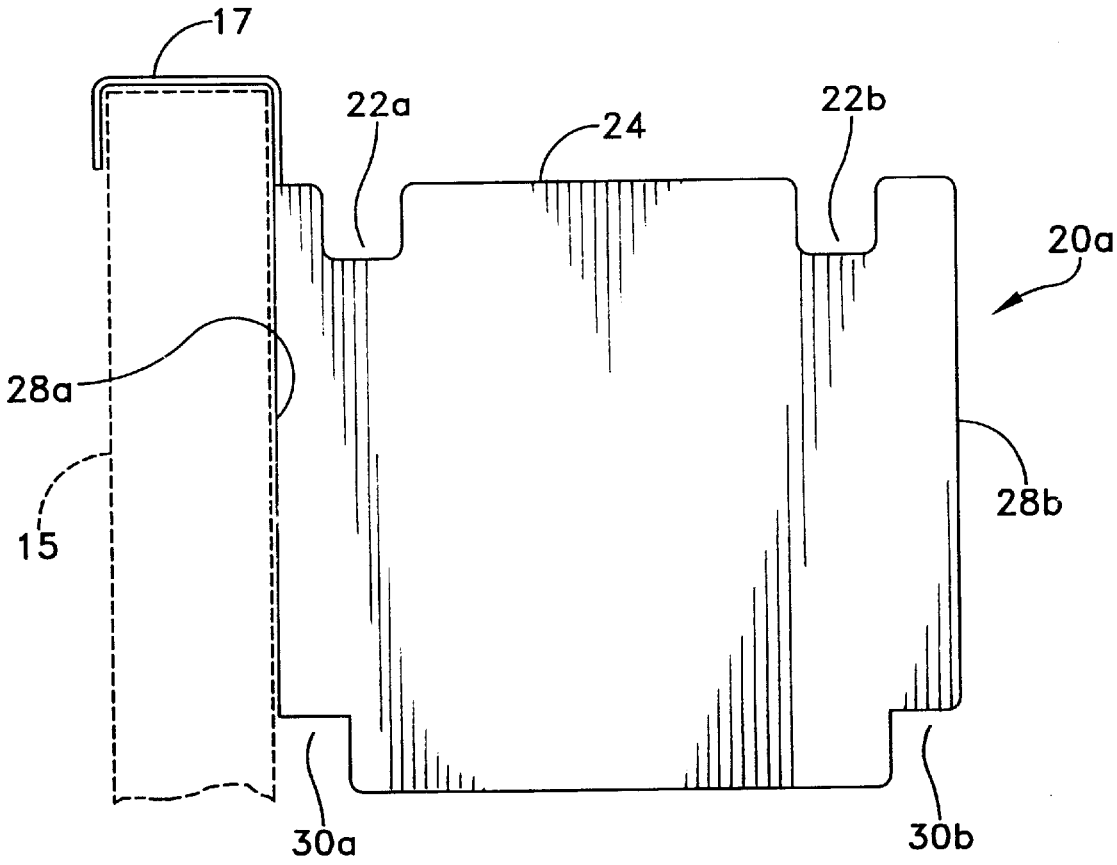
FIG. 3 is a side view of the holder of FIG. 2.

Referring now to FIGS. 1–5, a holder 10 designed to support a bag 12 having handles 14 in an open position is illustrated. The holder 10, which may be of metal or plastic construction, preferably includes a mounting member 16 for securing the holder to a support structure, such as a cabinet door or drawer 15. The mounting member 16 may be secured to the support structure by fastening members, such as screws or the like, or may include a reverse flange or hook 17 for removably securing the holder to the support structure without damage to the structure. Supported on either end 18*a, b* of the mounting member and extending therefrom are support arms 20*a, b*. The support arms 20*a, b* may be formed as a unitary structure with the mounting member, or alternately, may be removably attached thereto. The support arms 20*a, b* preferably are rigid in construction so as to provide sufficient support to the bag during use and may extend from the mounting member such that the support arms are substantially parallel to each other during use. Alternately, the support arms may be angled outwardly and away from each other, for example, toward the bottom of the arms, in order to help maintain the bag in the open position during use. As shown in the Figures, the support arms 20*a, b* each preferably include a pair of notches 22*a, b* formed in an upper edge 24 thereof. In the present embodiment, the notches 22*a, b* are spaced a distance from either end of the upper edge 24 of the support arms. The notches may have any suitable shape and size to receive the handles of the bag, and are preferably rectangular in shape in the present embodiment. The notches 22*a, b* help maintain the front edge 23 and rear edge 25 of the bag 12 in spaced relation to each other, i.e., the bag is held in an open position. The support arms 20*a, b* further include a pair of cutout portions 30*a, b* formed in opposite bottom corners disposed at the intersection of the lower edge 26 and side edges 28*a*, 28*b* of each of the support arms. The cutout portions 30*a, b* may preferably be formed at a right angle θ to receive the handles 14.

The notches 22*a, b* and cutout portions 30*a, b* together with the support arms 20*a, b* provide a support system for the bag in order to maintain the mouth 31 of the bag in an open position, and to provide the bag with sufficient support when filled. In particular, the body 11 of the bag is positioned between the support arms such that the handles 14*a*, 14*b* are received from an inner surface 33 of the support arms, through the notches 22*a*, 22*b*, downwardly over the outer surface 34, and are supported inwardly through the cutout portions 30*a, b*, as described in greater detail below. In this manner, as weight is added to the bag 12, the bag is supported by both the cutout portions 30*a, b* and the notches 22*a*22*b* such that as weight within the bag increases, the grip or hold between the handles and their respective support arms also increases.

Figure 4:
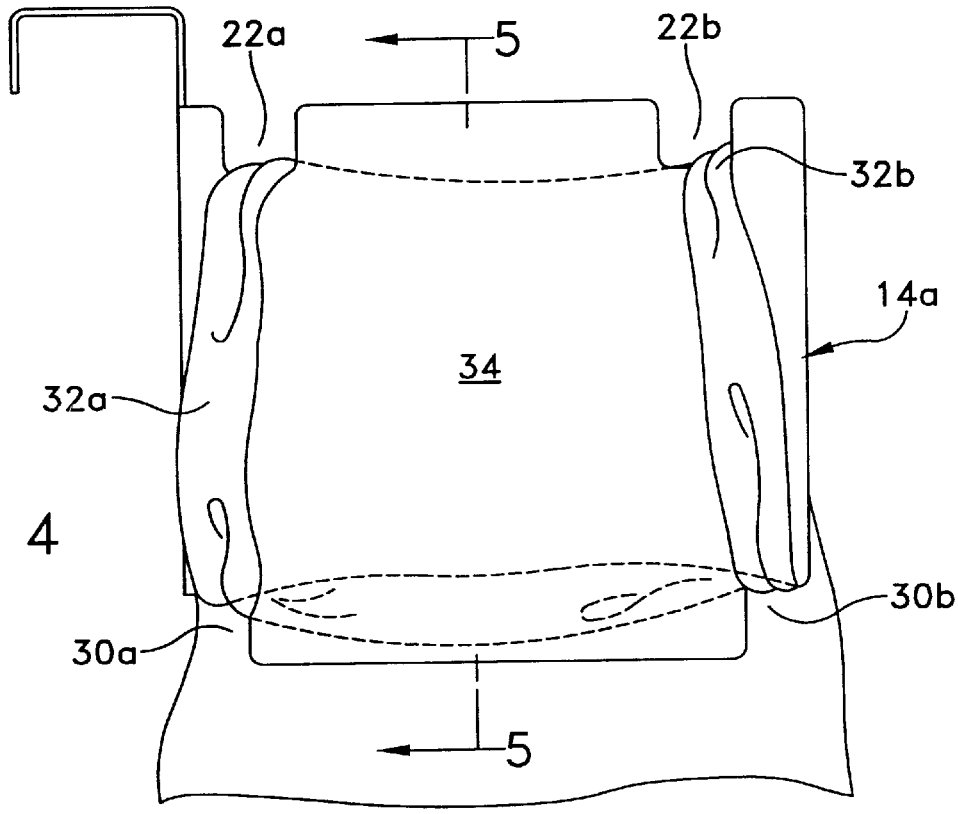
FIG. 4 is a side view of the holder and bag of FIG. 1.
Figure 5:
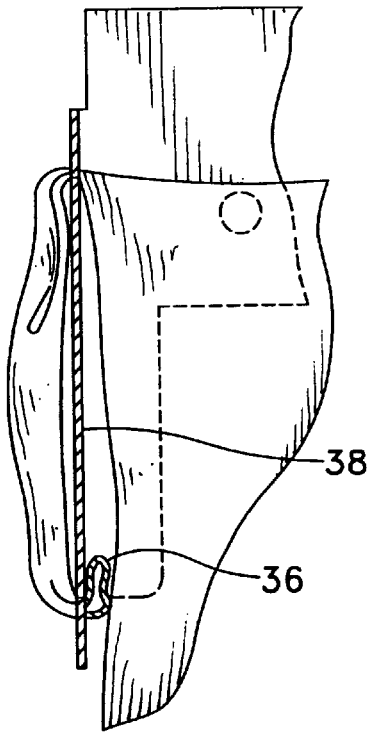
FIG. 5 is a cross sectional view taken along lines 5—5 of FIG. 4.

Use of the bag holder 10 will now be described in greater detail with reference to FIGS. 1, 4, and 5. In use, the holder is positioned on a support structure, for example by positioning hook 17 over drawer 15. The handles 14*a, b* of the bag, which are formed as a loop in a known manner, are then inserted from a position adjacent the inner surface 33 of the support arms, outwardly through the notches 22*a, b* of either support arm such that a first side 32*a* of each handle is received through inner notch 22*a*, and a second side 32*b* of each handle is received through outer notch 22*b*. The sides 32*a, b* of each handle 14*a, b* are then looped downwardly over an outer surface 34 of each support arm, and are then moved inwardly and secured within the corresponding inner and outer cutout portions 30*a, b*, respectively, of each arm. The lower portion 36 of each handle is thereby positioned adjacent an inner surface 38 of each support arm 20*a, b*. In this manner, the handles 14*a, b* of the bag are received in an interlocking fashion with the support arms of the holder 10 such that as weight within the bag increases, the grip or hold between the handles and their respective support arms also increases.

To remove the bag from the holder, each handle 14*a, b* is simply disengaged from the corresponding cutout portions 30*a, b*, and are removed from within notches 22*a*, 22*b*. If desired, multiple bags can be positioned within each other, such that as one bag is removed, another bag is already positioned within the holder to accept refuse, or other materials. The holder may also be removed from the support for storage by lifting the hook 17 from engagement with the drawer 15.

As will be appreciated, the bag holder disclosed herein maintains and supports a bag having handles in an open position, is easy to use and is easy to manufacture due to the simplicity of its design.

It will be understood that various modifications may be made to the embodiment disclosed herein. For example, the size, shape and position of the arms, notches and cutouts may be varied, as would be known to those of skill in the art. Therefore, the above description should not be construed as limiting, but merely as exemplifications of a preferred embodiment. Those skilled in the art will envision other modifications within the scope, spirit and intent of the invention.

What is claimed is:

1. In combination, a holder mountable to a support structure and a bag, the combination comprising:

a bag having a body, a front edge, a rear edge a first handle and a second handle;

a holder constructed and arranged to support the bag in an open position and including:

a) a mounting member constructed and arranged to attach the holder to the support structure;

b) a first support arm extending from one end of the mounting member and a second support arm extending from another end of the mounting member, the first and second support arms each including an upper edge, an inner surface, an outer surface, a pair of opposing side edges, and a lower edge;

c) a pair of notches formed in the upper edge of each of the first and second support arms, the notches constructed and arranged to maintain the front edge and the rear edge of the bag in spaced relation so as to maintain the bag in an open position;

d) a first and a second cutout portion formed at each lower corner where the side edges meet the lower edges of each of the first and second support arms; and the combination further characterized in that the first bag handle is positioned adjacent the first support arm and the second bag handle is positioned adjacent the second support arm, each bag handle extending from the inner surface of the adjacent support arm, through the pair of notches in the upper edge of each adjacent support arm, downwardly over the outer surface of the adjacent support arm, inwardly through the cutout portions, and across a bottom portion of the inner surface of the adjacent support arm, so that a top portion of each handle is engaged with the first and second cutout portions in interlocking removable engagement with its adjacent support arm, whereby as weight within the bag increases, holding forces between the handles and their adjacent support arm.

2. The combination of claim 1, wherein the first and second support arms are disposed substantially parallel to each other.

3. The combination of claim 1, wherein the mounting member includes a hook constructed and arranged to removably support the holder on a support surface.

4. The combination of claim 1, wherein the bag comprises a plurality of plastic bags stacked within each other.

5. The combination of claim 1, wherein the mounting member and support arms are formed as a unitary structure.

6. A method of supporting a bag having a first and a second handle in an open position comprising the steps of:

providing a holder including:

a) a mounting member;

b) a first support arm extending from one end of the mounting member and a second support arm extending from another end of the mounting member, the first and second support arms each including an upper edge, inner surface, an outer surface, a pair of opposing side edges, and a lower edge;

c) a pair of notches formed in the upper edge of each of the first and second support arms, the notches constructed and arranged to maintain a front edge and a rear edge of the bag in spaced relation so as to maintain the bag in an open position d) a first and a second cutout portion formed at each lower corner where the side edges meet the lower edges of each of the first and second support arms; and inserting a portion of the first bag handle from an inner surface of the first support arm through the pair of the notches formed in the first support arm;

inserting a portion of the second bag handle from an inner surface of the second support arm through the pair of notches formed in the second support arm;

extending a portion of the first bag handle downwardly over an outer surface of the first support arm;

extending a portion of the second bag handle downwardly over an outer surface of the second support arm;

removably securing a top portion of the first handle inwardly through the first and second cutout portions and across a bottom portion of an inner surface of the first support arm; and removably securing a top portion of the second handle inwardly through the first and second cutout portions and across a bottom portion of an inner surface have been inserted between "portions" of the second support arm.

* * * * *